US007871345B2

(12) United States Patent
Cooper

(10) Patent No.: US 7,871,345 B2
(45) Date of Patent: Jan. 18, 2011

(54) ARROWHEAD

(76) Inventor: Gary L. Cooper, 2106 Evening Dr., Pocahontas, AR (US) 72455

( * ) Notice: Subject to any disclaimer, the term of this patent is extended or adjusted under 35 U.S.C. 154(b) by 477 days.

(21) Appl. No.: 11/876,073

(22) Filed: Oct. 22, 2007

(65) Prior Publication Data

US 2008/0261734 A1 Oct. 23, 2008

Related U.S. Application Data

(60) Provisional application No. 60/865,707, filed on Nov. 14, 2006.

(51) Int. Cl.
*F42B 6/08* (2006.01)

(52) U.S. Cl. ..... 473/584

(58) Field of Classification Search ..... 473/582, 473/583, 584

See application file for complete search history.

(56) References Cited

U.S. PATENT DOCUMENTS 2,880,000 A 3/1959 Unger
3,854,723 A 12/1974 Wilson
4,210,330 A * 7/1980 Kosbab ..... 473/584
4,349,202 A * 9/1982 Scott ..... 473/584
4,616,835 A 10/1986 Trotter
4,643,435 A 2/1987 Musacchia
5,931,751 A 8/1999 Cooper
6,554,727 B1 * 4/2003 Armstrong et al. ..... 473/584

* cited by examiner

*Primary Examiner*—John Ricci
(74) *Attorney, Agent, or Firm*—Polster, Lieder, Woodruff & Lucchesi, L.C.

(57) ABSTRACT

A broadhead includes a one-piece elongated ferrule, with a plurality of slots through a central longitudinal axis of the ferrule, at least one of which has an open end, and one-piece blades mounted in the slots. At least one of the blades includes a blade slot in it and the blades having openings through them. A securing member is inserted transversely through the central longitudinal axis of the ferrule and passes through the openings of the blades securing them within the ferrule.

10 Claims, 3 Drawing Sheets

ARROWHEAD

CROSS-REFERENCE TO RELATED APPLICATIONS

This application claims priority to provisional application No. 60/865,707 filed on Nov. 14, 2006 and is incorporated herein by reference.

STATEMENT REGARDING FEDERALLY SPONSORED RESEARCH

Not Applicable.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
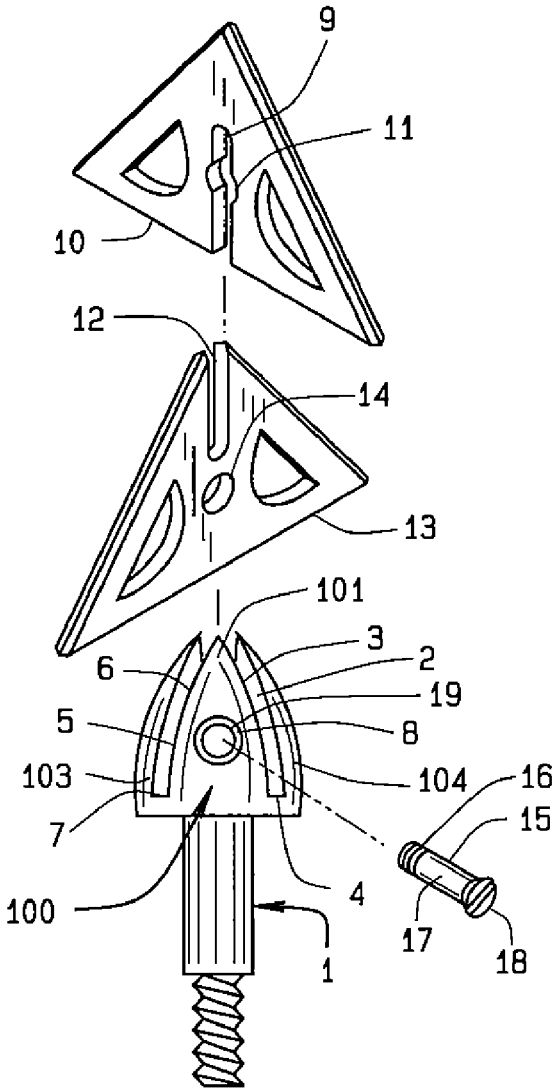
FIG. 1 is an exploded view in front elevation of blades, ferrule and set screw of one embodiment of arrowhead of this invention.

In the first embodiment of the present invention, referring to FIG. 1, a ferrule slot 2 is formed in a ferrule 1 with an upper open end 3 and lower closed end 4. A ferrule slot 5 is also formed in ferrule 1 with an upper open end 6 and lower closed end 7. The ferrule slots 2 and 5 are formed with axes at right angles to one another. As a result of the provision of the ferrule slots 2 and 5, the ferrule 1 has a body 100 and four segments 101, 102, 103, and 104. Segment 101 has hole 8, which may or may not be internally threaded, depending upon the kind of set screw 15 used, whose axis is transverse to the longitudinal axis of the ferrule 1, at a point between upper open end 3 and lower closed end 4. Segment 102 has a transverse, internally threaded hole 108, aligned with the hole 8. A blade slot, 9 is provided in a blade 10. Transverse hole 11 forms a central opening through blade 10. A blade slot 12 forms an opening in blade 13. Transverse hole 14 forms a central opening through blade 13. As can be seen, the slot 12 extends through the upper edge of the blade 13, while the slot 9 extends through the lower edge of the blade 10, the two blade slots being aligned when installed. Blades 10 and 13 are inserted into ferrule slots 2 and 5, and interengage with one another. Set screw 15 is shown as being threaded at its outer end 16 with a smooth shank 17 and a conical slotted head 18. The head 18 seats in a countersunk seat 19 at the entrance of hole 8. Alternatively, the hole 8 can be made sufficiently large to permit the passage of the threaded part of a fully threaded type set screw, or threaded. In any case, the set screw is pushed or screwed through transverse ferrule hole 8, passing through blade hole 11 in blade 10, and blade hole 14 in blade 13, and is screwed into internally threaded hole 108, securing blades 10 and 13 in alignment in the ferrule.

Figure 2:
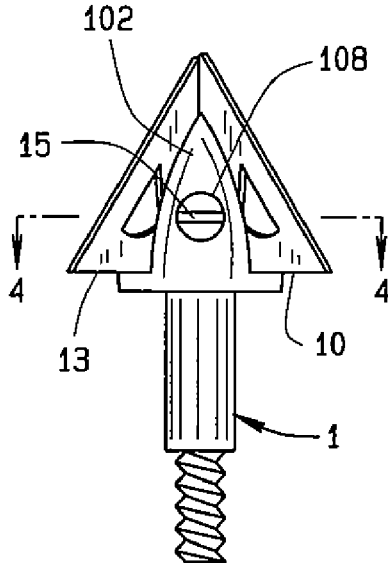
FIG. 2 is a view in rear elevation of the blades and ferrule of FIG. 1 assembled.

Referring to FIG. 2, the parts of FIG. 1 are assembled showing the complete arrowhead.

Figure 3:
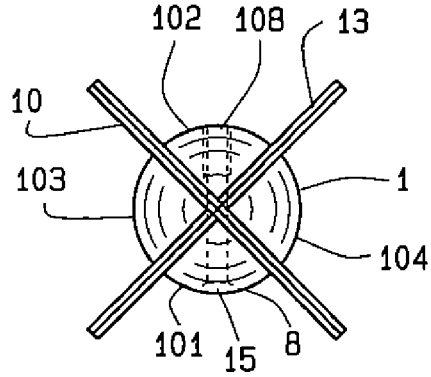
FIG. 3 is a top plan view of the arrowhead of FIG. 2.

Referring to FIG. 3, the orientation of the ferrule, blades and screw attachment is shown.

Figure 4:
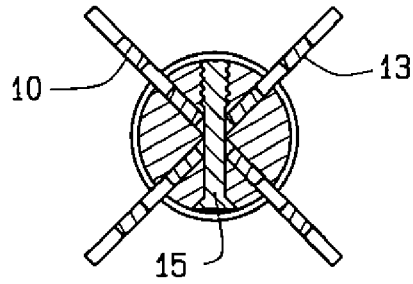
FIG. 4 is a sectional view taken along the line 4-4 of FIG. 1

Referring to FIG. 4, the passage of the set screw 15 through the blades 10 and 13 is illustrated.

Figure 5:
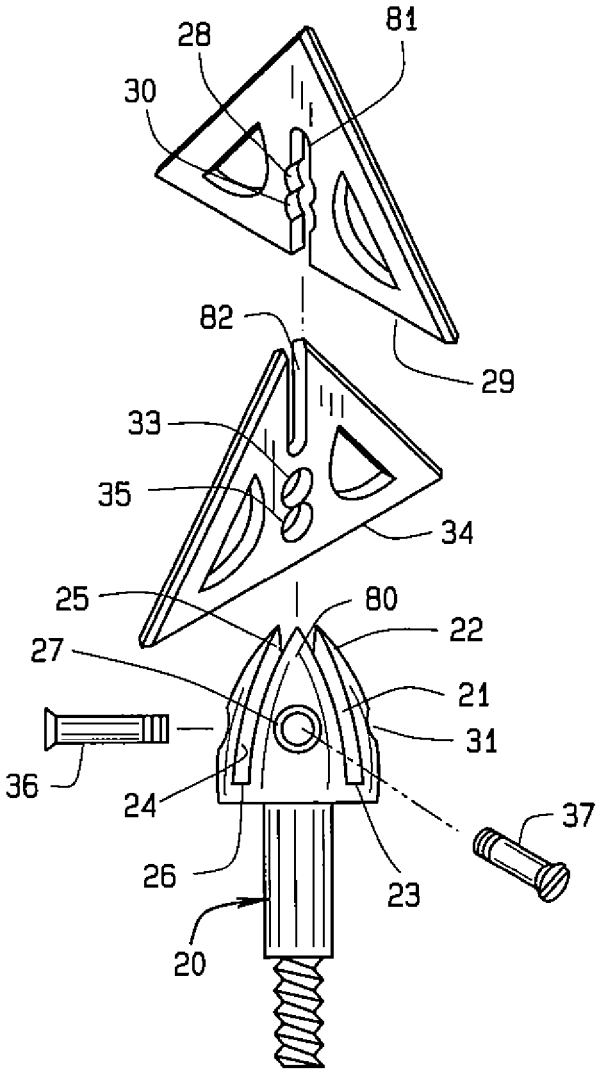
FIG. 5 is an exploded view in front perspective of blades, ferrule and set screws of a second embodiment.

Referring to FIG. 5, for a second embodiment, a ferrule 20 includes a slot 21 with an upper open end 22 and lower closed end 23. Ferrule 20 also includes a slot 24 with an upper open end 25 and lower closed end 26, oriented at right angles to the slot 21. As with the embodiment shown in FIGS. 1-3, the slots 21 and 24 define four segments, opposite ones of which, in this embodiment, have aligned holes in them. One pair of segments has aligned holes 27 and 31 whose axes are transverse to the longitudinal axis of the ferrule 20. Hole 31 is threaded. The hole 27 can be threaded or unthreaded, as has been described above. The other pair of segments has holes 27' and 31', whose axes are also perpendicular to the longitudinal axis of the ferrule 20, but positioned closer to the tip of the segments than the holes 27 and 31, sufficiently far as to accommodate a second set screw. In this embodiment, the exterior surfaces of the segments of the ferrule 20 are concave. Slot 81 forms an opening in blade 29. Transverse hole 28 forms an opening through blade 29. Transverse hole 30 forms another opening through blade 29. Slot 82 forms an opening in blade 34. Transverse hole 33 forms an opening through blade 34. Transverse hole 35 forms another opening through blade 34. Blades 29 and 34 are inserted into slots 21 and 24, and interengage. Set screw 36 is applied to transverse ferrule hole 27, passing through blade hole 28 in blade 29, and blade hole 33 in blade 34, securing blades 29 and 34 in alignment. Set screw 37 is applied to transverse ferrule hole 31, passing through blade hole 30 in blade 29, and blade hole 35 in blade 34, further securing blades 29 and 34 in alignment. As is the case in the embodiment shown in FIGS. 1-3, the screws holding the blades can either be fully threaded or threaded only at their ends, in the latter case, with a smooth shank passing through the initial hole, and a head, preferably countersunk, to limit the travel of the screw, and permit its tightening.

Figure 6:
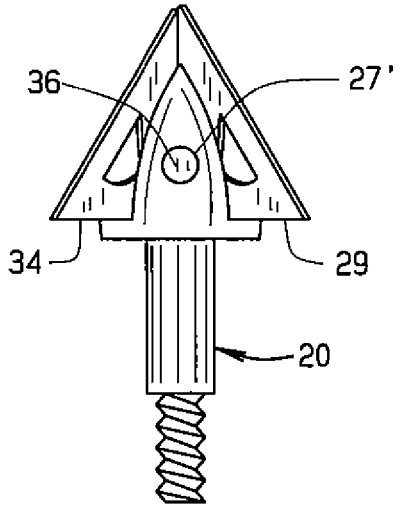
FIG. 6 is a view in side elevation of the blades and ferrule of FIG. 4 assembled.

Referring to FIG. 6, the parts of FIG. 4 are shown assembled to form the complete arrowhead.

Figure 7:
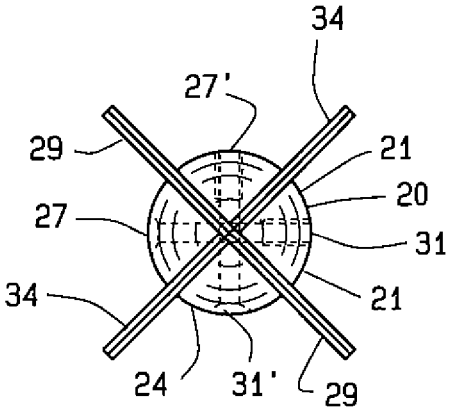
FIG. 7 is a top plan view of the arrowhead of FIG. 5.

Referring to FIG. 7, the orientation of the ferrule, blades and screw attachments is shown.

Figure 8:
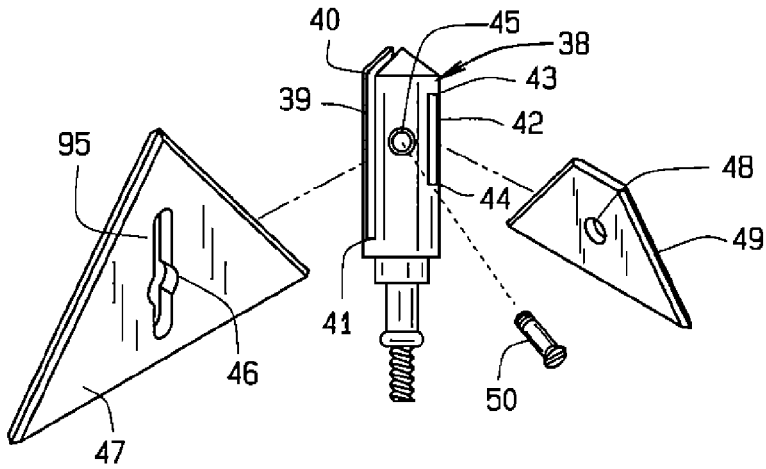
FIG. 8 is an exploded view in front elevation of a third embodiment.

Referring to FIG. 8, ferrule 38 includes slot 39 with an upper open end 40 and lower closed end 41. Ferrule 38 also includes a slot in the form of an aperture 42 with an upper closed end 43 and closed lower end 44, oriented at right angles to the slot 39. Ferrule 38 has a hole 45 whose axis is transverse to the longitudinal axis of the ferrule 38, and an aligned, internally threaded hole 45' on the other side of the slot 39. Transverse slot 95 forms an opening in blade 47.

Transverse hole 46 forms an opening through blade 47. Transverse hole 48 forms an opening through blade 49. Blade 47 is inserted in slot 39 and blade 49 is then inserted in slot 42, interengaging blade 47. Set screw 50 is applied to transverse ferrule hole 45, passing through blade hole 46 in blade 47 and blade hole 48 in blade 49, and screwing into internally threaded hole 45', securing blades 47 and 49 in alignment.

Figure 9:
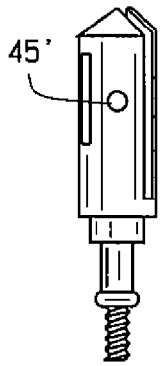
FIG. 9 is a view in rear elevation of the ferrule of FIG. 8.

Referring to FIG. 9, the ferrule of FIG. 8 is shown with the internally threaded hole 45' is shown.

Figure 10:
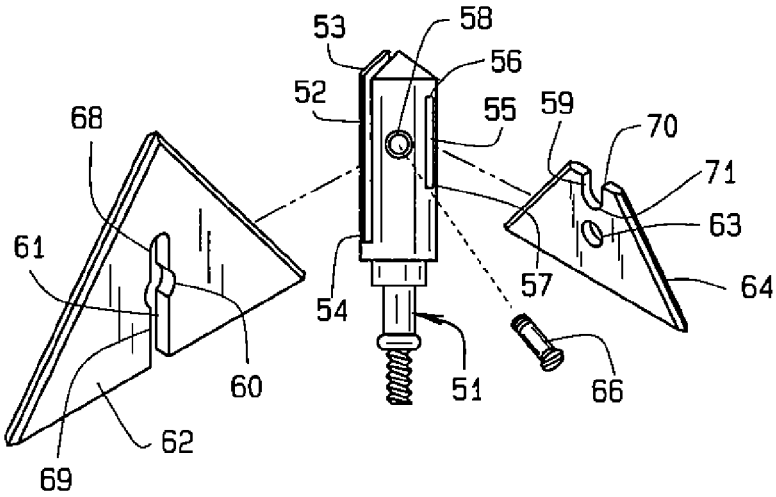
FIG. 10 is an exploded view in front perspective of a fourth embodiment.

Referring to FIG. 10, a ferrule 51 includes slot 52 with an upper open end 53 and lower closed end 54. Ferrule 51 also includes a slot in the form of an aperture 55 with an upper closed end 56 and closed lower end 57. Ferrule 51 has a hole 58 whose axis is transverse to the longitudinal axis of the ferrule 51, and an internally threaded hole 58' on the opposite side of the slot 52. Slot 61 in blade 62 has a closed upper end 68 and an open lower end 69 and passes through the central axis of the blade 62. Transverse hole 60 forms an opening through blade 62. Slot 59 in blade 64 has an open upper end 70 and a closed lower end 71. Transverse hole 63 forms a second opening through blade 64. Blade 64 is inserted in slot 55, and blade 62 is then inserted in slot 52 interengaging blade 64. Set screw 66 is pushed or screwed through transverse hole 58, passing through blade hole 60 in blade 62 and blade hole 63 in blade 64, and screwed into hole 58', securing blades 62 and 64 in alignment.

Figure 11:
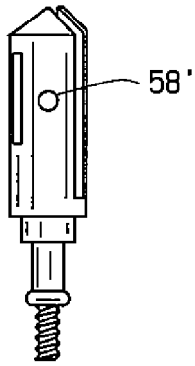
FIG. 11 is a view in rear elevation of the ferrule of FIG. 10.

FIG. 11 shows internally threaded hole 58'.

The set screws 15, 36, 37, and 50 are preferably made with a head fitting in a countersink in the hole to which it is introduced, that hole being unthreaded and slightly larger than an unthreaded part of the shank of the screw, the screw being threaded at its outer section that engages threads in the other hole as has been illustrated and described. In this way the screw tends to clamp the blade when it is tightened, and at the same time, it is easier to insert. However, the holes can both be threaded, as can the entire shank of the screw.

Numerous variations in the construction of the broadhead of this invention will occur to those skilled in the art in the light of the foregoing disclosure. The external shapes or dimensions of the blades and the angles of the sharp edges can be varied. The sets of slots may be offset from one another longitudinally. The blades may be offset at an angle relative to the ferrule. The body of the ferrule and the tip can be made polygonal, rather than smoothly cylindrical, with flat, concave, or convex sides. The terminal portion of the ferrule may also include numerous fittings besides the threaded shank. The blades may have top ends that are blunt, recessed or pointed. The blades edges may be straight or irregular, such as serrated. The ferrule slots need not be symmetrical in longitudinal orientation nor are the ferrule slots necessarily the same longitudinal length. The slots may be different widths in respect to one another. The blades may be the same or different length, width or height with respect to one another. The ferrule slots may be formed at an angle other than 90 degrees with respect to each other, for instance 120 degrees. One or both blade tips may extend forward from the ferrule, be flush with the ferrule, or be contained within the ferrule. If a heavier arrowhead is desired, the ferrule can be made longer. Mounting means other than screws can be employed, as a key slot or bayonet type member. Although the head of the screws illustrated are slotted, they can be provided with a Phillips head or other such head. If the blades are not to be replaced, the mounting means can be a rivet, although that is not a preferred variation. These are merely illustrative.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A broadhead comprising:

a one-piece elongated ferrule, a first ferrule slot having an open upper end, and a second ferrule slot having an open upper end, the ferrule slots dividing the ferrule into four segments, a first one-piece blade mounted in the first ferrule slot, the first one-piece blade having a first blade slot in the top thereof, a second one-piece blade having a second blade slot through a bottom thereof, the second blade being inserted into the second ferrule slot, an upper end of the second blade slot in the second one-piece blade interlocking with the first blade slot in the first one-piece blade, and a securing member inserted transversely through an opening in at least the second one-piece blade to retain the second one-piece blade and the first one-piece blade in the ferrule.

2. The broadhead of claim 1 wherein said blades include openings through which said securing member passes, said opening of at least one of said blades being larger than an outer dimension of a portion of said securing member that passes through said opening of said at least one of said blades.

3. The broadhead of claim 1 wherein said securing member is a screw engaging opposite ferrule segments.

4. The broadhead of claim 1, comprising multiple securing members.

5. The broadhead of claim 4, wherein said multiple securing members are screws, one screw passing through openings in both blades engaging two opposite ferrule segments, and a second screw passing through openings in both blades and engaging the two remaining ferrule segments.

6. The broadhead of claim 1, wherein said one-piece blades are of different lengths.

7. The broadhead of claim 1, wherein said ferrule slots are of different lengths.

8. The broadhead of claim 1, wherein one of said blades is positioned with a portion of its length above the other said blade.

9. The broadhead of claim 1, wherein said ferrule slots are the same length and said blades are of different lengths.

10. The broadhead of claim 1, wherein the first one-piece blade and the second one-piece blade extend above the ferrule.

* * * * *